US006084605A

United States Patent [19]

Yaji

[11] Patent Number: 6,084,605

[45] **Date of Patent: *Jul. 4, 2000**

[54] INK JET PRINTER

[75] Inventor: Masao Yaji, Tokyo, Japan

[73] Assignee: Oki Data Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/852,469

[22] Filed: May 7, 1997

[30] Foreign Application Priority Data

May 10, 1996 [JP] Japan ..... 8-116626

[51] Int. Cl.[7] ..... B41J 2/195

[52] U.S. Cl. ..... 347/19

[58] Field of Search ..... 347/7, 19, 69, 347/92, 23

[56] References Cited

U.S. PATENT DOCUMENTS 4,293,867 10/1981 Isayama ..... 347/23
4,625,220 11/1986 Nagashima ..... 347/23
4,695,852 9/1987 Scardovi ..... 347/23
5,241,189 8/1993 Vandagriff et al. ..... 347/7
5,414,452 5/1995 Accantino et al. ..... 347/7
5,432,540 7/1995 Hiraishi ..... 347/69
5,677,718 10/1997 Crawford et al. ..... 347/92

FOREIGN PATENT DOCUMENTS 3-32852 2/1991 Japan .

*Primary Examiner*—John Barlow
*Assistant Examiner*—Charles W. Stewart, Jr.
*Attorney, Agent, or Firm*—Akin, Gump, Strauss, Hauer & Feld, L.L.P.

[57] ABSTRACT

An ink jet printer has ink pressure chambers defined by opposed walls formed of a piezoelectric material. The walls distorts in shear mode to eject ink drops from the ink pressure chambers when voltages are applied to the walls in accordance with print data. A row of ink pressure chambers eject ink drops through orifices during printing operation. A second ink pressure chamber is in communication with the other ink pressure chambers. An ink-state detector provides a voltage to the second ink pressure chamber to measure the impedance of the ink between the walls of the second ink pressure chamber. The impedance reflects the remaining amount of remaining ink.

11 Claims, 6 Drawing Sheets

INK JET PRINTER

BACKGROUND OF THE INVENTION

1. Technical Field of the Invention

The present invention relates to an ink jet printer where ink drops are ejected from an ink pressure chamber made of a piezoelectric material when the ink pressure chamber is deformed.

2. Description of Related Art

A conventional ink jet printer is provided with electrodes within an ink tank and the amount of ink in the ink tank is determined by measuring an impedance between the electrodes. When the amount of ink in the ink tank is below a predetermined value, a message such as "ink end" is indicated to the user prompting replenishment of the ink or replacement of the ink tank, thereby ensuring continued printing operation.

However, the aforementioned conventional printer is disadvantageous in that electrodes used only for detecting the amount of ink are required within the ink tank.

SUMMARY OF THE INVENTION

An object of the invention is to provide an ink jet print head where the amount of the remaining ink in the ink pressure chambers and/or ink tank may be detected without providing electrodes exclusively used for ink detection.

An ink jet printer has ink pressure chambers defined by opposed walls formed of a piezoelectric material, the walls being deformed to eject ink drops from the ink pressure chambers when voltages are applied to the walls in accordance with print data.

An ink jet printer according to the present invention has a plurality of ink pressure chambers which communicate with an ink tank. One of the ink pressure chambers is not used for printing. The ink jet printer has an ink-state detector which provides a voltage to the opposed walls of the unused pressure chamber.

The measured impedance reflects the state of the ink in the ink pressure chamber. Thus, measuring the impedance yields information on, for example, a remaining amount of ink.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
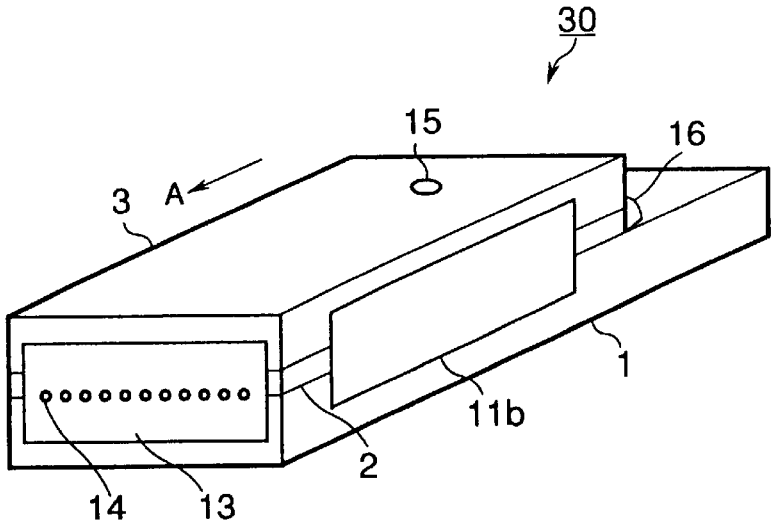
FIG. 1 is a perspective view of the ink jet head.

A preferred embodiment of the present invention will be described in detail with reference to the drawings. Like elements have been given like reference numerals throughout the drawings.

The embodiment will be described by way of ink pressure chambers made of a piezoelectric material. The walls of the ink pressure chambers are deformed in shear mode to pressurize the ink therein, thereby ejecting ink drops through the orifices.

Figure 2:
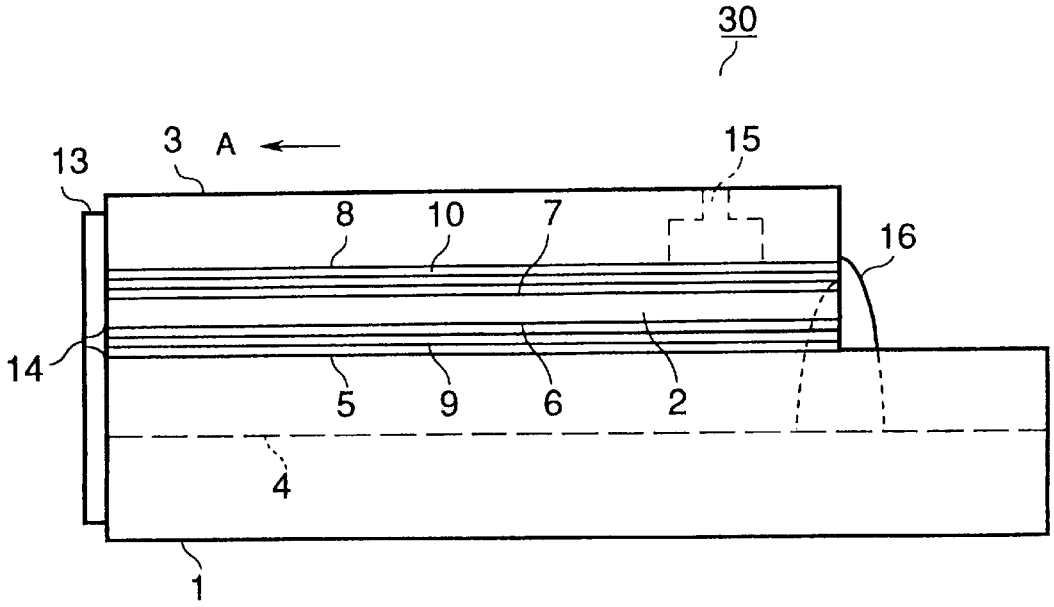
FIG. 2 is a side view of the ink jet head of FIG. 1.

FIG. 1 is a perspective view of the ink jet head 30 and FIG. 2 is a side view of the ink jet head when a later described bonding member 11*b* is not assembled.

Referring to FIGS. 1 and 2, the ink jet head 30 includes a base body 1, intermediate body 2, and top body 3 which define a plurality of ink pressure chambers when assembled in a stacked structure. The base body 1 is polarized in a direction shown by arrow P (FIG. 5) and has base electrodes 5*a* to 5*e*. The intermediate body 2 is sandwiched between the intermediate electrodes 6 and 7. The top body 3 includes an ink replenishing opening 15 formed therein and a common electrode 8 that extends over the entirety of the inner surface of the top body 3. The top body 3 is connected electrically and mechanically to the intermediate body 2 by a conductive adhesive member 10 interposed between electrodes 7 and 8. The base body 1 is connected electrically and mechanically to the intermediate body 2 by a conductive adhesive member 9 interposed between electrodes 5 and 6.

The ink pressure chambers are closed at one ends thereof by an orifice plate 13 having orifices through which ink drops are ejected (direction shown by arrow A in FIG. 2), and is scaled at, the other ends thereof by an adhesive 16. Thus, the ink pressure chambers 4*a*–4*c* are sealed against the environment except for the ink replenishing opening 15 and the orifices 14 through which the ink chambers communicate with the environment.

Figure 3:
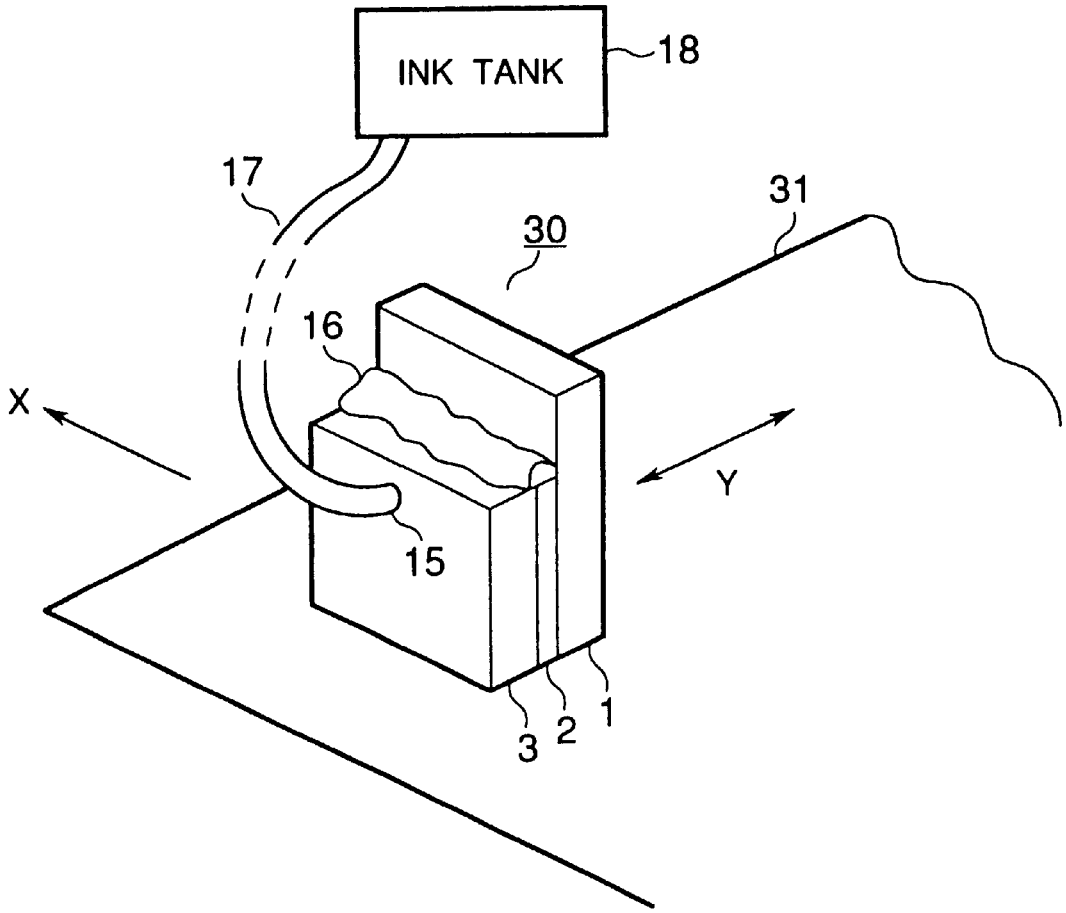
FIG. 3 is a perspective view of the ink jet head of the invention when printing.

FIG. 3 is a perspective view of the ink jet head 30 when printing. The ink jet head 30 is moved across the paper 31 in a direction shown by arrow Y while the paper is being fed in a direction shown by arrow X. The ink jet head 30 is connected to an ink tank 18 through a flexible tube 17.

Figure 4:
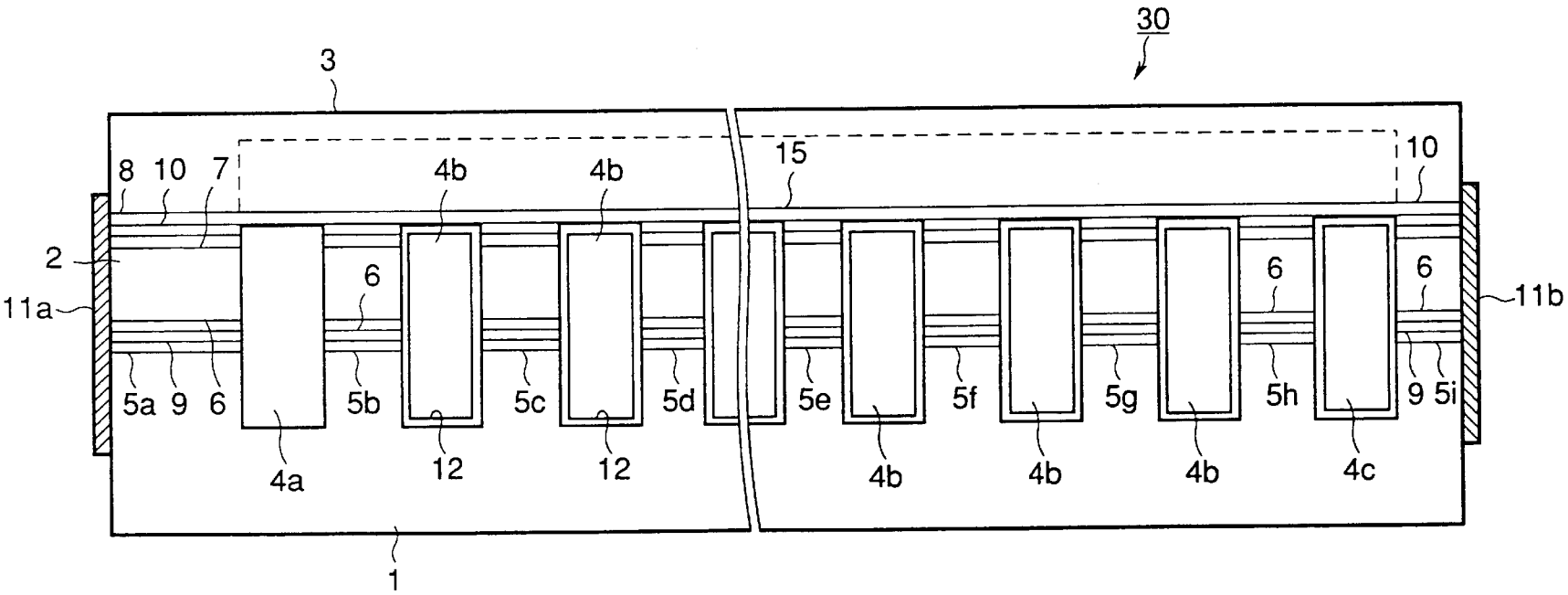
FIG. 4 is a front view of the ink jet head of FIG. 1 before the orifice plate is assembled.

FIG. 4 is a front elevation view of the ink jet head 30 before the orifice plate 3 is assembled. A coating layer 12 is provided on the inner walls of the ink pressure chambers 4*b* and 4*c* so as to insulate the ink from electrodes 5, 6, 7, 8, and conductive adhesive layers 9 and 10. It is to be noted that the inner walls of the ink pressure chamber 4*a* are not provided with the coating layer 12 for a later described reason. The common electrode 8 is electrically continuous with the base electrodes 5*a* and 5*i* via the bonding members 11*a* and 11*b*, respectively, and is connected at a rear end of the ink jet head 30 to a ground electrode of an external electrical circuit, not shown.

Figure 5:
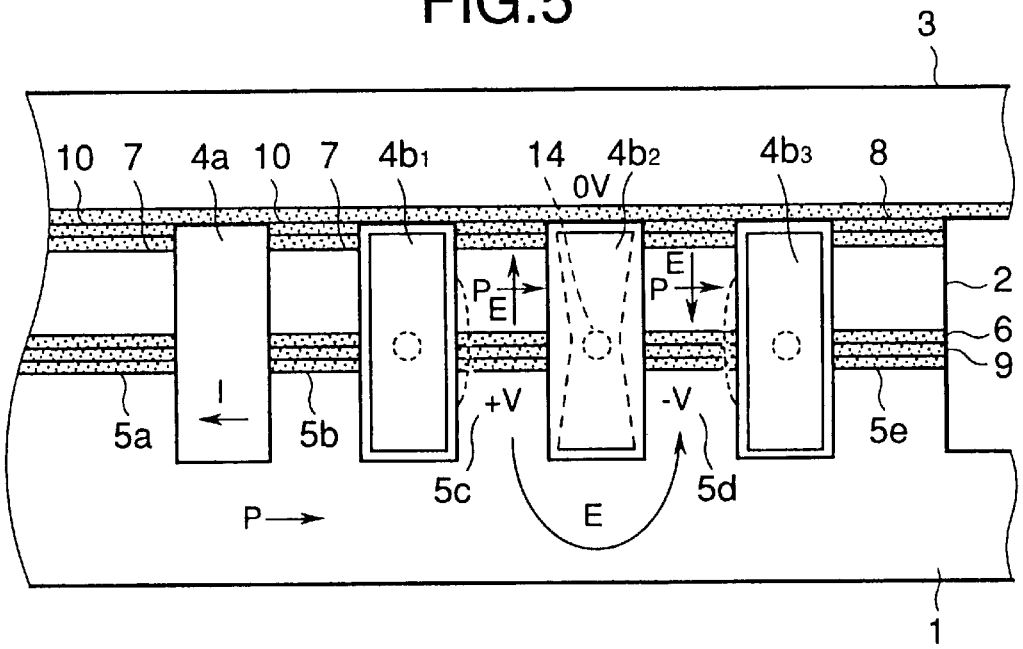
FIG. 5 is a fragmentary view of the ink jet head of FIG. 1.

FIG. 5 is a fragmentary view of the ink jet, head 30. The base body 1 is polarized in a direction shown by arrow P and is provided with base electrodes 5a–5i (only electrodes 5b–5e are shown). The intermediate body 2 is also polarized in the direction shown by arrow P. With the common electrode 8 connected to 0 volts, for example, a positive predetermined voltage +V is applied to the base electrode 5c and a negative predetermined voltage −V to the base electrode 5d. An electric field E is developed in the intermediate body 2 and base body 1 in directions shown by arrow E so that the base body 1 and intermediate body 2 are deformed in the shear mode as shown by dotted lines. The deformation of the base body 1 and intermediate body 2 pressurizes the ink in the ink pressure chamber 4b2 causing the ink drops to be ejected from the ink pressure chamber 4b2.

Figure 6:
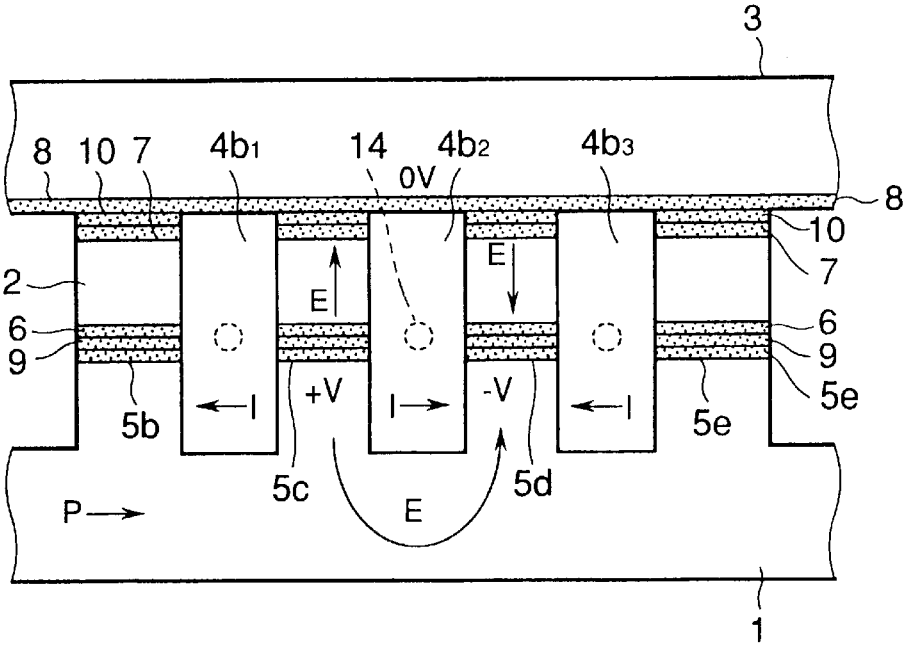
FIG. 6 is a fragmentary view of the ink jet head of FIG. 1 illustrating operation of the the ink pressure chambers.

When the positive and negative voltages +V and −V are applied, for example, to the base electrodes 5c and 5d, respectively, to eject ink drops through the orifice 14 as shown in FIG. 6, voltages of zero volts are applied to the base electrodes 5b and 5e of the base body 1. The electric fields developed between the electrodes 5b and 5c and between the base electrodes 5d and 5e are not high enough to cause sufficient deformation of the intermediate body 2 and base body 1 for ink drops to be ejected through the orifices 14. FIG. 6 illustrates the ink pressure chambers when the coating layer is not applied thereto. If the coating layer 12 is not provided on the inner walls of the ink pressure chambers 4b2, 4b3 and 4b1, then teak currents I flow through the ink in the pressure chambers 4b2, 4b3 and 4b1, causing the electric fields E to decrease. A decrease in electric field E results in a decreased deformation of the ink pressure chambers, hence decreased amount of ink in ejected ink drops. If the pressure decreases below a certain level, no ink drops are ejected.

Referring back to FIG. 5, the base electrodes 5a and 5i at the extreme ends of the row of the ink pressure chambers are connected to the ground electrode of the external electrical circuit which is at zero volts. Therefore, the ink pressure chambers 4a and 4c adjacent to the base electrodes 5a and 5i do not receive high enough voltages, failing to eject ink drops.

It is to be noted that the ink pressure chamber 4a adjacent to the base electrode 5a is not provided with the coating layer 12 on its inner wall. Thus, when voltages are applied to the base electrode 5b and 5a, a current I flows through the ink in the ink pressure chamber 4a. Thus, the remaining amount of ink in the printer can be detected as a function of an impedance of the ink determined on the basis of the current I. The amount of ink in the ink pressure chamber 4a is the same as that in the other ink pressure chambers since the ink pressure chambers all are in communication with one another. The orifice plate 13 is usually not formed with orifices 14 therein at the location opposing the ink pressure chamber 4a.

The coating layer 12 is formed by, for example, chemical vapor deposition (CVD). The coating material is evaporated on the inner walls of the ink pressure chambers with the orifice plate 13 mounted to the ink jet head 30. if an orifice is formed at a location opposing the ink pressure chamber 4a, the orifice is masked with, for example, a tape when the coating layer 12 is applied to the inner walls of the ink pressure chambers.

Figure 7:
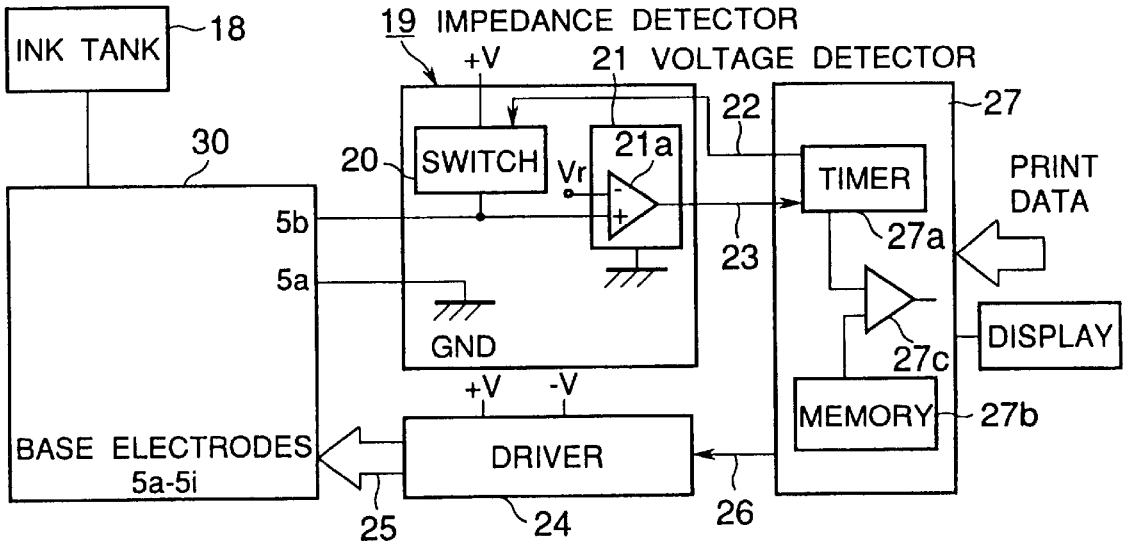
FIG. 7 is a block diagram illustrating the ink jet printer of the embodiment.

The control system of the embodiment will now be described with reference to FIG. 7. FIG. 7 is a block diagram illustrating the ink jet printer of the embodiment.

A controller 27 controls the entire operation of the printer. The controller 27 outputs an ink detecting command 22 to the impedance detector 19 and receives a voltage detection signal 23 from the impedance detector 19. The controller 27 and impedance detector 19 form an ink-state detector which detects a remaining amount of ink in the printer. The impedance detector 19 includes a switch circuit 20 and voltage detector 21. The voltage detector 21 comprises a comparator 21a and the comparator 21a receives a reference voltage Vr at its negative input terminal and a voltage of the base electrode 5b at its positive input terminal. The value of the reference voltage Vr is determined by experiment. The comparator 21a compares the voltage of the base electrode 5b with the reference voltage Vr and provides a voltage detection signal 23 of a high logic level to the controller 27 when the voltage of the base electrode 5b exceeds the reference voltage Vr.

When the controller 27 outputs a head drive signal 26 to the driver 24, the driver 24 starts driving the head 30. The driver 24 outputs head drive signal 25, i.e., the positive and negative drive voltages +V and −V in accordance with the print data to the base electrodes 5a–5i.

The controller 27 includes a timer 27a, memory 27b, and comparator 27c. The timer 27a times a time period T from the time it outputs the ink detecting command 22 to the impedance detector 19 till it receives the voltage detection signal 23. The time period T is the time required for the voltage of the base electrode 5b to exceed the reference voltage Vr after the voltage +V is applied via the switch 20 to the electrode 5b. The time T will be described later in more detail. Stored in the memory 27b are the typical values of T corresponding to the remaining amounts of the ink in the printer, and a plurality of messages representative of the remaining amounts of ink in the printer such as "normal," "near empty," and "empty."

Figure 8:
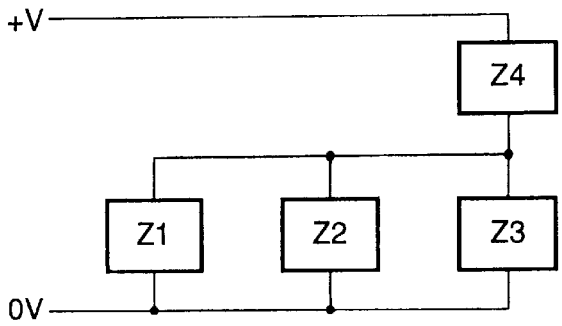
FIG. 8 illustrates an equivalent electrical circuit of the ink jet head of the invention.

FIG. 8 illustrates an equivalent electrical circuit in terms of the electrical impedances of the switch 20, ink pressure chambers 4a, and ink in the ink pressure chamber 4a. Referring to FIG. 8, Z1 is the impedance of the base body 1 between base electrodes 5a and 5b. Z2 is the impedance of the intermediate body 2 between the base electrodes 5a and 5b. Z3 is the impedance of the ink between the base electrodes 5a and 5b. Z4 is the impedance of the switch 20 in the impedance detector 19.

As previously mentioned, the coating layer 12 is not formed on the inner walls of the ink pressure chamber 4a and therefore a leak current I flows through various electrical paths including the conductive adhesive member 9, intermediate electrode 6, intermediate body 2, the ink in the ink pressure chamber 4a, and base electrode 5a to the ground. Thus, the impedances Z1, Z2, and Z3 form a parallel circuit which is in series with the impedance Z4 of the switch 20. A resultant impedance Z0 is given by $$Z0=Z4+Z1\cdot Z2\cdot Z3/Z2\cdot Z3+Z1\cdot Z3+Z1\cdot Z2 \quad (1)$$

Therefore, the time T is expressed as a function in terms of the impedances Z1 to Z4 and the voltage +V as follows:

$$T=f(+V, Z1, Z2, Z3, Z4) \quad (2)$$

The time T is a direct function of the impedance Z3 when the voltage +V and the impedances Z1, Z2, and Z4 are constant and known. The time T reflects the impedance Z3 of the ink between the electrodes 5a and 5b.

The impedance Z3 varies depending on the remaining amount of ink in the printer. The impedance Z3 may also reflect the other properties of the ink. In addition, a maximum capacity of an ink tank and type of ink vary depending on the models of printer. Thus, the values of time T are previously measured by experiment for individual models of printer. The values of time T represent various levels of the remaining amount of ink, e.g., "normal," "nearly empty," and "empty."

The "normal" is a case where the respective ink pressure chambers 4*b* and ink tank 18 are full of ink, or some amount of ink remains in the ink tank 18 and the respective ink pressure chambers are full of ink.

The "nearly empty" is a case where the respective ink pressure chambers are full of ink but the ink tank 18 is empty.

The "empty" is a case where the ink tank 18 is empty and the respective ink pressure chambers are filled with air.

The time T is a time length required for the voltage on the base electrode 5*a* to exceed the reference voltage Vr after the application of the voltage +V via the switch 20.

Figure 9:
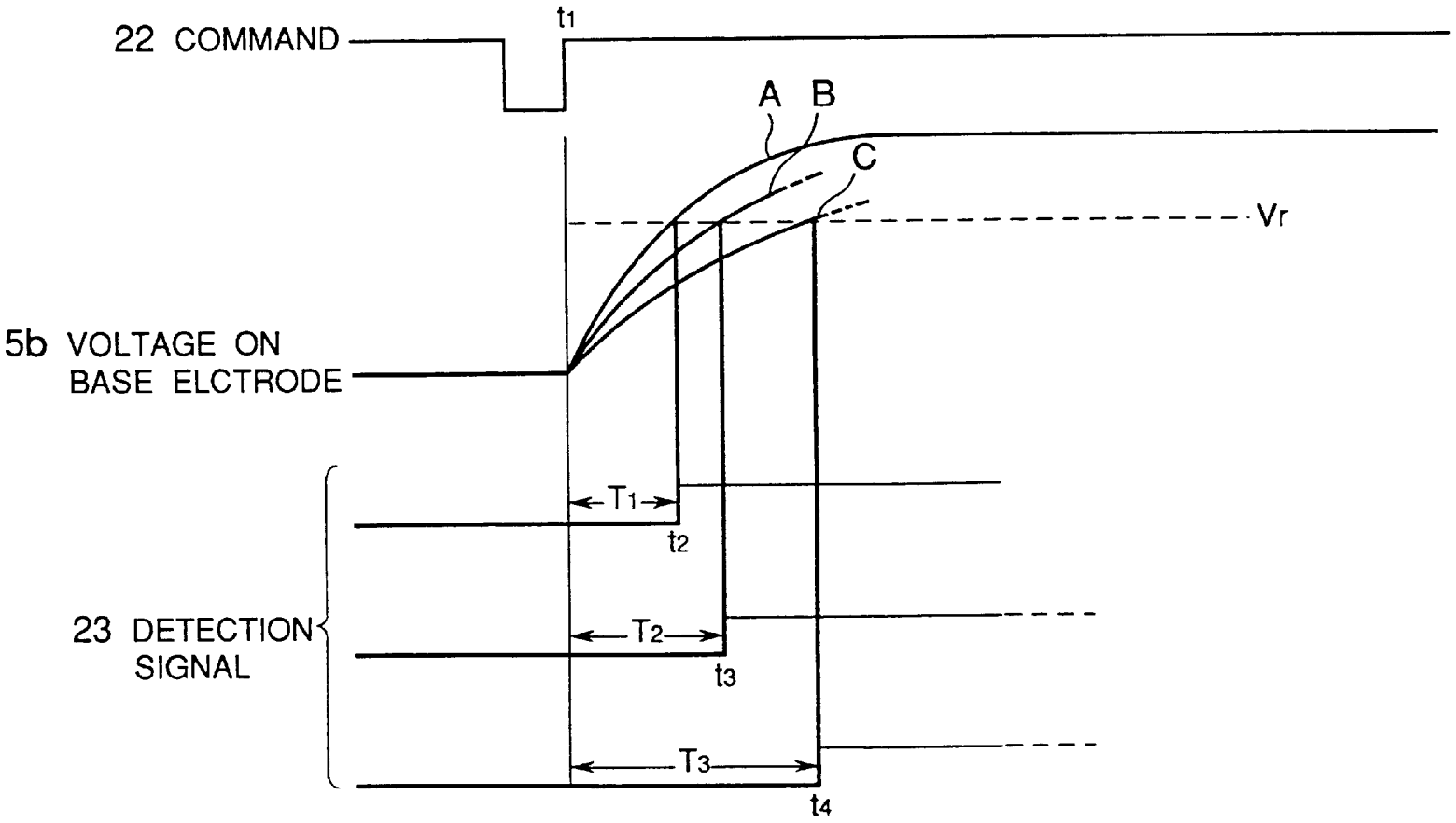
FIG. 9 is a timing chart illustrating the relation between the amount of ink in the ink chamber and the corresponding voltage on the base electrode.

FIG. 9 is a timing chart illustrating the relation among the ink detecting command 22, reference voltage Vr, voltage on the base electrode 5*b*, and voltage detection signal 23. Curves A, B, and C show different states of ink, i.e., remaining amount of ink in the printer. The curves rise progressively rapidly as the remaining ink approaches its empty state. Curves A, B, and C intersect the reference voltage Vr at time t2, t3, and t4, respectively. Time lengths T3, T2, and T1 are typical values for "normal state," "near empty," and "empty," respectively. The typical values of T3, T2, and T1 are experimentally measured and stored in the memory 27*b*.

In operation, the comparator 27*c* in the controller 27 compares the measured time length T with the values of T1, T2, and T3 stored in the memory 27*b* to determine the remaining amount of ink. The remaining amount of ink is "normal" if T2<T<T3, "near empty" if T1<T<T2, and "empty" if T<T1. The "empty" and "near empty" states are displayed on a display of the printer, not shown.

The ink-detecting operation of the embodiment will be described with reference to FIGS. 7 and 9.

Prior to printing operation, the controller 27 outputs the ink detecting command 22 (FIG. 7) to the impedance detector 19 in order to detect the remaining amount of the ink. Upon receiving the ink detecting command 22, the switch 20 closes at time t1 to apply the voltage +V to the base electrode 5*b* through the impedance Z4.

The comparator 21*a* starts monitoring the voltage on the base electrode 5*b* immediately after the switch 20 is closed. The comparator 21*a* compares the reference voltage Vr with the voltage on the base electrode 5*b*. The comparator 21*a* outputs the voltage detection signal 23 to the controller 27 when the voltage on the base electrode 5*b* exceeds the reference voltage Vr. The controller 27 counts the time length T from ink detecting command 22 till the voltage detection signal 23 is outputted, and subsequently compares the time length T with times T1, T2, and T3, thereby detecting the remaining amount of ink in the printer.

If the time T indicates "normal" and the print data has been received, the controller 27 sends the drive command 26 to the driver 24. The driver 24 outputs head drive signal 25 to the base electrodes 5*a*–5*i* which correspond to the print data, in order to print data. If print data has not been received, the controller 27 enters its standby condition.

If the time T indicates "near empty," the controller 27 sends a message such as "please replenish ink" to the display. A message may also be outputted which indicates the number of pages the printer is able to print using the remaining ink.

If the time T indicates "empty," the controller 27 sends a message such as "ink end/print halted/please replenish ink" to the display.

The ink detecting operation may be performed upon power-up of the printer or shortly after the printing operation is completed.

The ink pressure chamber 4*a* is in communication with all of the other ink pressure chambers via the ink replenishing opening 15 which in turn communicates with the ink tank 18 through the pipe 17. Thus, the time T reflects the impedance between the electrodes 5*a* and 5*b*, i.e., resultant impedance of the ink in all of the ink pressure chambers. The present invention is capable of detecting the "near empty" state prior to "empty" state of the ink, indicating to the user that only a small amount of ink is left in the printer, urging the user to replenish ink or replace the ink tank 18 before the ink pressure chambers dry up due to air entering the ink pressure chambers.

In the present invention, a check is made to determine the state of remaining amount of ink in the ink pressure chamber 4*a* which is not designed for printing operation but in communication with the other ink pressure chambers designed for printing operation. This construction eliminates the need for providing exclusive ink-detecting electrodes within, for example, the ink tank 18. Thus, this construction allows cost reduction of the printer.

Detecting the state of ink prior to the printing operation prevents the user from worrying about ink jet head running dry in the middle of a printing operation, saving time and paper.

If the impedane of the ink reflects, for example, viscosity of the ink rather than the remaining amount of ink, then such information may be effectively used to properly drive the ink jet head 30 to eject ink drops in accordance with the viscosity or ink. Thus, the present invention is effective in maintaining satisfactory printing quality.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet printer comprising:

a plurality of first ink pressure chambers each holding ink, each first chamber being defined by opposed walls formed of piezoelectric material, the walls of each chamber being deformable to eject ink drops from each such first ink pressure chamber when a first voltage is applied to the walls of each respective first ink chamber during a printing operation;

a second ink pressure chamber in fluid communication with each of said plurality of first ink pressure chambers and also holding ink, the second ink pressure chamber being defined by opposed walls formed of piezoelectric material, the second ink pressure chamber not ejecting ink drops during the printing operation; and an ink-state detector, producing a detection signal representing information on a state of the ink between the walls of the second ink pressure chamber as an indication of the state of the ink in each of the plurality of first ink chambers.

2. The ink jet printer according to claim 1, wherein the ink-state detector outputs a second voltage through an impedance element to the walls of said second ink pressure chamber, the state of the ink determining a time length until a third voltage across the walls of said second ink chamber exceeds a predetermined value.

3. The ink jet printer according to claim 2, wherein said ink-state detector includes:

a controller for outputting an ink detecting command;

a switch including the impedance element for outputting the second voltage through the impedance element to the walls of said second ink pressure chamber upon receiving the ink detecting command from the controller;

a voltage detector, outputting said detection signal when the third voltage across the walls of said second ink pressure chamber exceeds the predetermined value after said ink detecting command is supplied to said switch;

wherein the controller outputs said ink detecting command to said switch to count a time length from the output of said command until said voltage detector outputs the detection signal to determine the remaining amount of ink on the basis of the time length.

4. The ink jet printer according to claim 3, wherein said controller includes:

a timer for counting a time length from the output of said command until said voltage detector outputs the detection signal; and a memory in which a plurality of items of data representing predetermined time lengths are stored;

wherein said controller compares the time length counted by the timer with the predetermined time lengths to determine the remaining amount of ink, the remaining amount of ink being "normal" if $T2<T<T3$, "near empty" if $T1<T<T2$, and "empty" if $T<T1$ where T is the time length counted by the timer.

5. The ink jet printer according to claim 1, wherein said first and second ink pressure chambers are in communication with an ink tank.

6. The ink jet printer according to claim 1, wherein inner surfaces of the walls of the first ink pressure chambers are coated with an insulating material preventing electrical contact of the walls with the ink, and the walls of the second ink pressure chamber are directly in electrical contact with the ink in the second ink pressure chamber.

7. The ink jet printer according to claim 1, wherein said ink-state detector produces said detection signal before a printing operation.

8. The ink jet printer according to claim 1, wherein said ink-state detector produces said detection signal after printing operation.

9. The ink jet printer according to claim 1, wherein said ink-state detector produces said detection signal upon power-up of the printer.

10. The ink jet printer according to claim 1, wherein said information is an impedance of the ink between the walls of said second ink pressure chamber.

11. The ink jet printer according to claim 1, wherein said state of ink is a remaining amount of ink.

* * * * *